US009127384B2

(12) United States Patent
Ichiyanagi et al.

(10) Patent No.: US 9,127,384 B2
(45) Date of Patent: Sep. 8, 2015

(54) SEWING MACHINE AND NON-TRANSITORY COMPUTER-READABLE MEDIUM STORING COMPUTER-READABLE INSTRUCTIONS FOR THE SEWING MACHINE

(71) Applicants: Satoru Ichiyanagi, Nagoya (JP); Yutaka Nomura, Anjo (JP); Yoshio Nishimura, Nagoya (JP); Yoshinori Nakamura, Toyohashi (JP); Akie Shimizu, Nagoya (JP); Daisuke Abe, Nagoya (JP); Yuki Ihira, Kakamigahara (JP)

(72) Inventors: Satoru Ichiyanagi, Nagoya (JP); Yutaka Nomura, Anjo (JP); Yoshio Nishimura, Nagoya (JP); Yoshinori Nakamura, Toyohashi (JP); Akie Shimizu, Nagoya (JP); Daisuke Abe, Nagoya (JP); Yuki Ihira, Kakamigahara (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 191 days.

(21) Appl. No.: 14/025,272

(22) Filed: Sep. 12, 2013

(65) Prior Publication Data

US 2014/0090587 A1 Apr. 3, 2014

(30) Foreign Application Priority Data

Sep. 28, 2012 (JP) ..... 2012-217001

(51) Int. Cl.
*D05B 19/12* (2006.01)

(52) U.S. Cl.
CPC ..... *D05B 19/12* (2013.01); *D05D 2205/00* (2013.01); *D05D 2205/085* (2013.01)

(58) Field of Classification Search
CPC ..... D05B 19/02; D05B 19/08; D05B 19/085; D05B 19/10; D05B 19/105; D05B 19/12; D05C 2205/00; D05C 2205/08; D05C 2205/085
USPC ..... 700/136–138
See application file for complete search history.

(56) References Cited

U.S. PATENT DOCUMENTS

| | | | |
|---|---|---|---|
| 6,304,793 | B1 | 10/2001 | Komiya et al. |
| 2010/0314229 | A1 | 12/2010 | Ominato |
| 2011/0203505 | A1 | 8/2011 | Nagai et al. |

FOREIGN PATENT DOCUMENTS

| | | |
|---|---|---|
| JP | A-11-57262 | 3/1999 |
| JP | A-2006-87811 | 4/2006 |
| JP | A-2010-287381 | 12/2010 |
| JP | A-2011-172801 | 9/2011 |

*Primary Examiner* — Danny Worrell
(74) *Attorney, Agent, or Firm* — Oliff PLC

(57) ABSTRACT

A sewing machine includes a bed, a sewing device, a projection portion, an item detection portion, and a control portion. The sewing device includes a needle bar and a feed portion that moves a work cloth. The projection portion projects, onto at least one of the bed and the work cloth, a projected image that includes at least one operation item that indicates an operation of the sewing device. The item detection portion detects whether a user's finger has touched a location, on the at least one of the bed and the work cloth onto which the at least one operation item is being projected by the projection portion, where one of the at least one operation item is being projected. The control portion operates the sewing device in accordance with the operation item that has been detected by the item detection portion.

13 Claims, 9 Drawing Sheets

SEWING MACHINE AND NON-TRANSITORY COMPUTER-READABLE MEDIUM STORING COMPUTER-READABLE INSTRUCTIONS FOR THE SEWING MACHINE

CROSS-REFERENCE TO RELATED APPLICATION

This application claims priority to Japanese Patent Application No. 2012-217001, filed on Sep. 28, 2012, the content of which is hereby incorporated by reference.

BACKGROUND

The present disclosure relates to a sewing machine that is capable of operating without a user removing one hand from a work cloth, and a non-transitory computer-readable medium storing computer-readable instructions for the sewing machine.

A sewing machine is known in which various types of buttons, such as a start button, a stop button, and the like, are provided on an arm. A user of the sewing machine can perform an operation that is related to sewing by pressing one of the buttons at any desired time.

SUMMARY

The user ordinarily performs the sewing on a work cloth while holding the work cloth lightly with both hands such that the position on the work cloth where the sewing will be performed does not shift. However, when the user issues a command to start, stop, sew a reverse stitch, or the like, the user must take one hand off of the work cloth to operate the button that is disposed on the arm. In a case where the user operates the button, the sewing is performed in a state in which the work cloth is temporarily held by only one hand, so there is a possibility that the work cloth will shift away from the position where the sewing is to be performed.

Embodiments of the broad principles derived herein provide a sewing machine in which the user is able to command the operations of sewing devices while holding the work cloth with both hands, and a non-transitory computer-readable medium that stores a control program executable on the sewing machine.

The sewing machine according to the present disclosure includes a bed on which a work cloth is placed, a sewing device, a projection portion, an item detection portion, and a control portion. The sewing device includes a needle bar, on a lower end of which a sewing needle is mounted, and a feed portion that moves the work cloth. The projection portion projects, onto at least one of the bed and the work cloth, a projected image that includes at least one operation item that indicates an operation of the sewing device. The item detection portion detects whether a user's finger has touched a location, on the at least one of the bed and the work cloth onto which the at least one operation item is being projected by the projection portion, where one of the at least one operation item is being projected. The control portion operates the sewing device in accordance with the operation item that has been detected by the item detection portion.

Embodiments also provide a sewing machine including a processor and a memory configured to store computer-readable instructions. The instructions cause the processor to perform processes comprising projecting, onto at least one of a bed on which a work cloth is placed and the work cloth by a projection portion, a projected image that includes at least one operation item that indicates an operation of a sewing device including a needle bar, on a lower end of which a sewing needle is mounted, and a feed portion that moves the work cloth, detecting whether a user's finger has touched a location, on the at least one of the bed and the work cloth onto which the at least one operation item is being projected by the projection portion, where one of the at least one operation item is being projected, and operating the sewing device in accordance with the operation item that has been detected.

Embodiments further provide a non-transitory computer-readable medium storing computer readable instructions for a sewing machine. The computer readable instructions cause the sewing machine to perform the following steps, projecting, onto at least one of a work cloth and a bed on which the work cloth is placed, a projected image that includes at least one operation item that indicates an operation of a sewing device that performs sewing on the work cloth, detecting whether a user's finger has touched a location, on the at least one of the bed and the work cloth onto which the at least one operation item is being projected, where one of the at least one operation item is being projected, and causing the sewing device to perform an operation that corresponds to the operation item that has been detected.

BRIEF DESCRIPTION OF THE DRAWINGS

Embodiments will be described below in detail with reference to the accompanying drawings in which.

DETAILED DESCRIPTION

Figure 1:
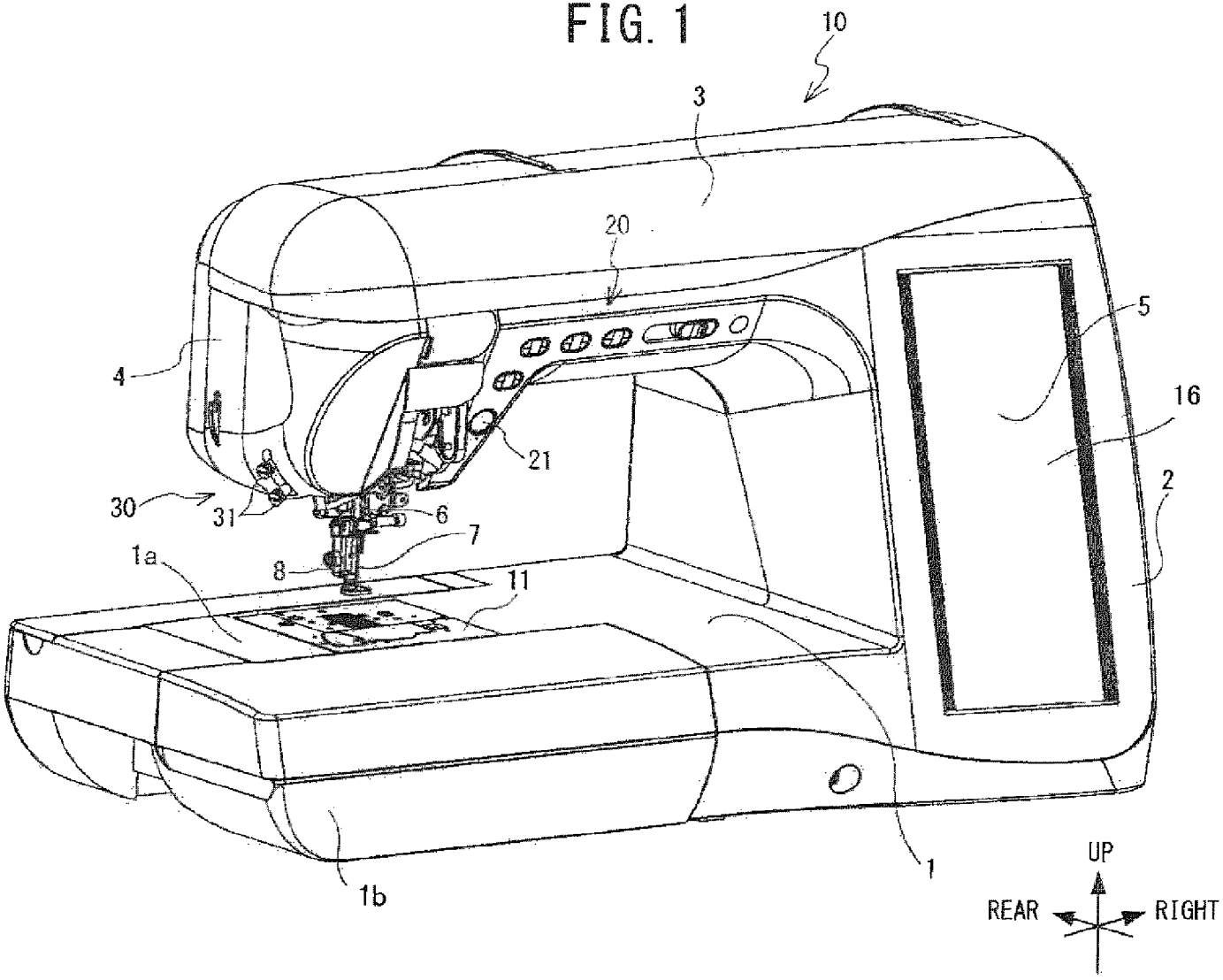
FIG. 1 is an oblique view of a sewing machine 10 in a first embodiment of the present disclosure.

Hereinafter, an embodiment of a sewing machine 10 that implements the present disclosure will be explained with reference to the drawings. Note that the drawings are used for explaining technological features that the present disclosure can utilize. Accordingly, device configurations, flowcharts for various types of processing, and the like that are shown in the drawings are merely explanatory examples and do not serve to restrict the present disclosure to those configurations, flowcharts, and the like, unless otherwise indicated specifically.

Configuration of the Sewing Machine 10 in the First Embodiment

The physical configuration of the sewing machine 10 in the first embodiment will be explained with reference to FIGS. 1 to 4. Directions in the first embodiment will now be defined. The top side, the bottom side, the lower right side, the upper left side, the upper right side, and the lower left side in FIG. 1 respectively correspond to the top side, the bottom side, the front side, the rear side, the right side, and the left side of the sewing machine 10. The sewing machine 10 is provided with a bed 1, a pillar 2, an arm 3, and a head 4. The bed 1 is the base portion of the sewing machine 10, and it has a flat surface on which a work cloth W can be placed. The pillar 2 extends upward from the bed 1. The arm 3 extends to the left from the pillar 2 and faces the bed 1. The head 4 is provided on the end of the arm 3.

Sewing devices include a needle bar 6, as well as a shuttle mechanism, a feed dog, a cloth feed mechanism, a drive shaft, a needle bar up-and-down moving mechanism, a presser bar up-and-down moving mechanism, and a thread-cutting mechanism that cuts an upper thread and a lower thread, although these are not shown in the drawings.

The bed 1 is provided with a body 1*a* and an auxiliary table 1*b*. A needle plate 11 is provided in the body 1*a*. The auxiliary table 1*b* is removably mounted on the front side of the body 1*a*.

The shuttle mechanism is provided underneath the needle plate 11. The shuttle mechanism contains a bobbin around which the lower thread is wound. The body 1*a* contains the feed dog and the cloth feed mechanism. The feed dog feeds the work cloth W, which is the object of the sewing, by a specified feed amount. The cloth feed mechanism operates the feed dog. A feed adjustment pulse motor 79 (FIG. 6) adjusts the amount and the direction of the feeding by the feed dog of the work cloth W that has been placed on the bed 1. A lower shaft that rotates in synchronization with the drive shaft is provided in the body 1*a*. The shuttle mechanism and the feed mechanism are driven by the rotation of the lower shaft. The thread-cutting mechanism is provided next to the left side of the shuttle mechanism. The thread-cutting mechanism may be the known mechanism that is described in Japanese Laid-Open Patent Publication No. 2006-87811, for example. The thread-cutting mechanism operates by being driven by a thread-cutting pulse motor 83 (FIG. 6), and it cuts the upper thread and the lower thread.

Figure 6:
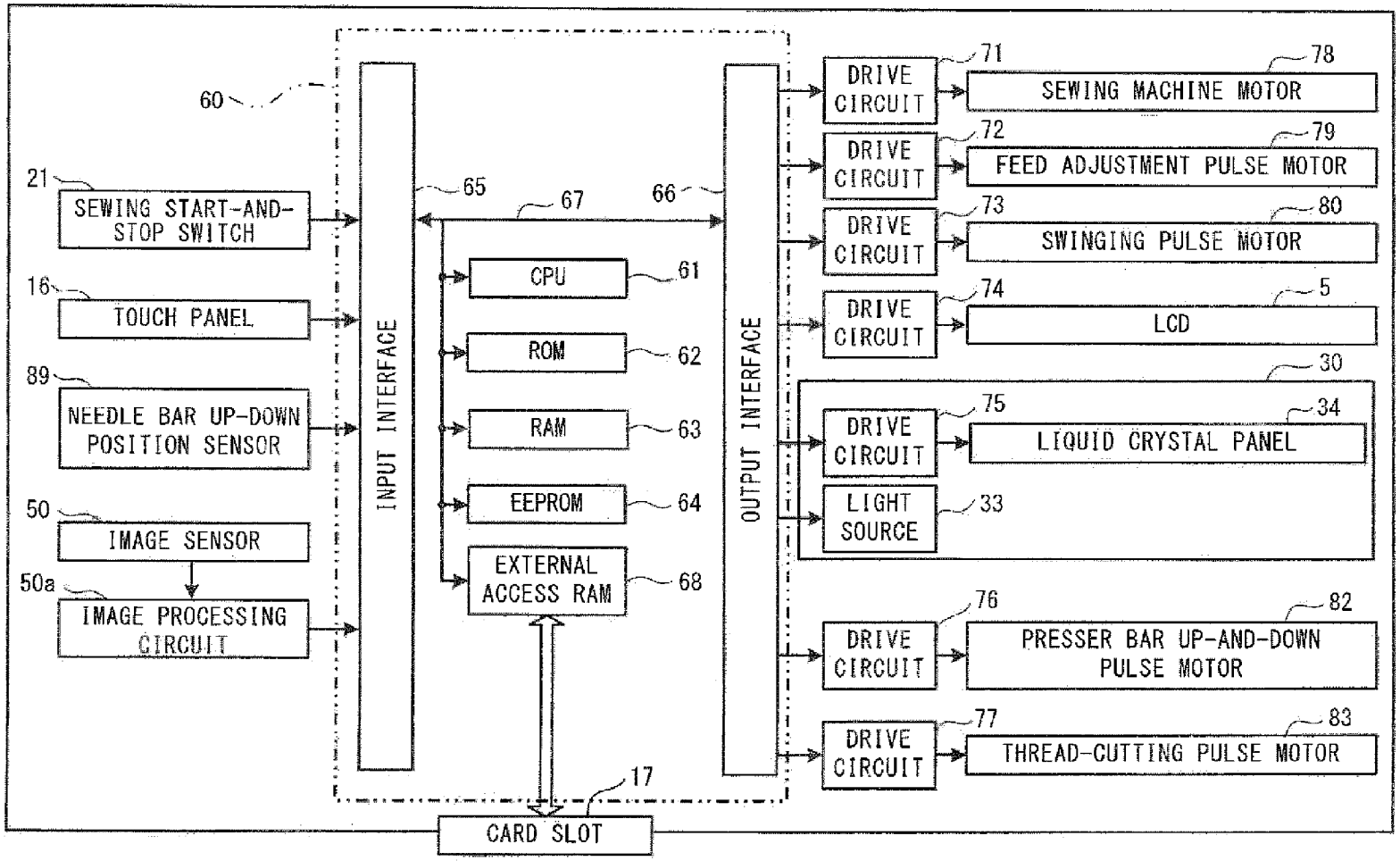
FIG. 6 is a block diagram that shows an electrical configuration of the sewing machine 10.

An LCD 5 is provided on the front face of the pillar 2. The LCD 5 is provided with a touch panel 16 on its surface. The LCD 5 may display, for example, a plurality of types of embroidery patterns and input keys for inputting sewing conditions. By touching the positions on the touch panel 16 that correspond to the embroidery patterns and the input keys that are displayed on the LCD 5, the user can select the embroidery patterns and the sewing conditions. A switch cluster 20 is provided on the front face of the arm 3. The switch cluster 20 includes a sewing start-and-stop switch 21. The sewing start-and-stop switch 21 issues commands to start and stop a sewing machine motor 78 that is shown in FIG. 6.

Figure 5:
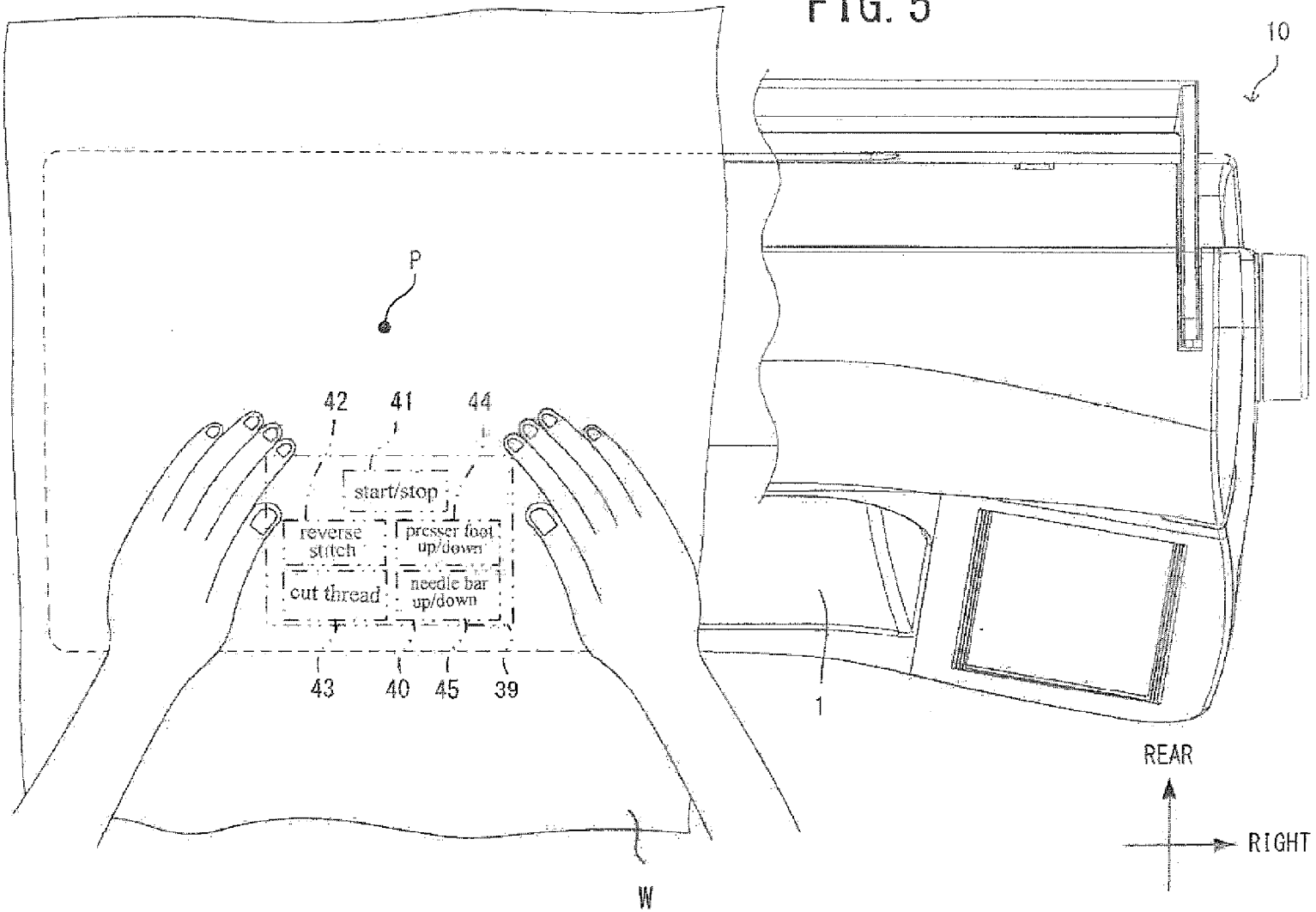
FIG. 5 is a plan view of the sewing machine 10 in which operation items 40 are projected onto the work cloth W by the projector 30.
Figure 8:
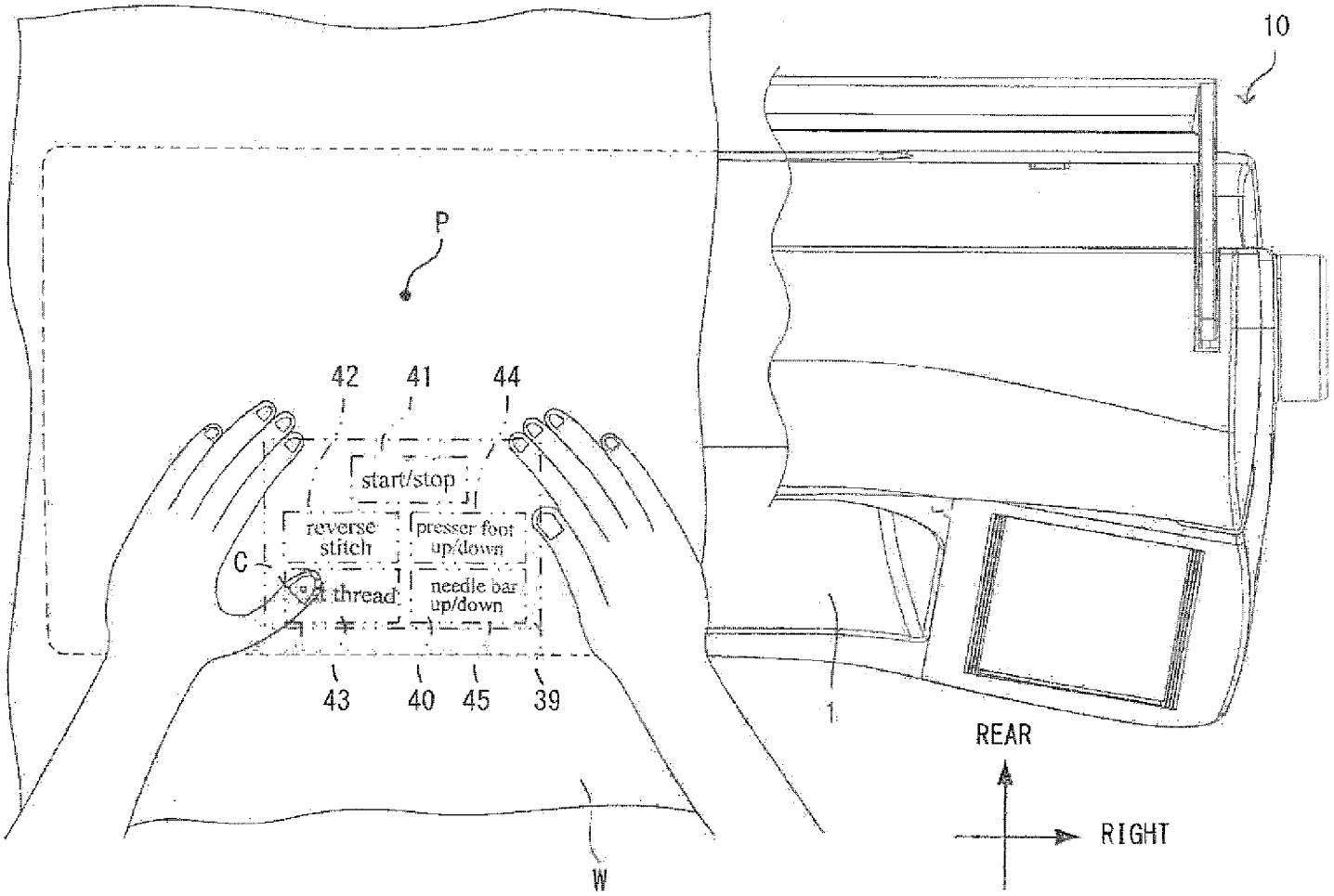
FIG. 8 is a plan view of the sewing machine 10 that shows a state in which a user's finger is touching the work cloth W, on which the operation items 40 are projected.

A projector 30 projects a projected image 39 that is shown in FIGS. 5 and 8 onto one of the bed 1 and the work cloth W that has been placed on the bed 1. The projector 30 is mounted on the left front side inside the head 4. A pair of adjustment screws 31 of the projector 30 project to the outside of the head 4. The adjustment screws 31 adjust the focus of the projected image 39 that is projected. Because the projector 30 projects the projected image 39 obliquely onto the one of the bed 1 and the work cloth W from above, distortion occurs in the projected image 39 that is corrected by known image correction processing, although a detailed explanation of this will be omitted.

The sewing machine motor 78 (FIG. 6) is contained in the pillar 2. The drive shaft is provided in the arm 3. The sewing machine motor 78 rotates the drive shaft through a timing belt. The rotational force of the drive shaft is transmitted to the lower shaft through the timing belt.

Figure 3:
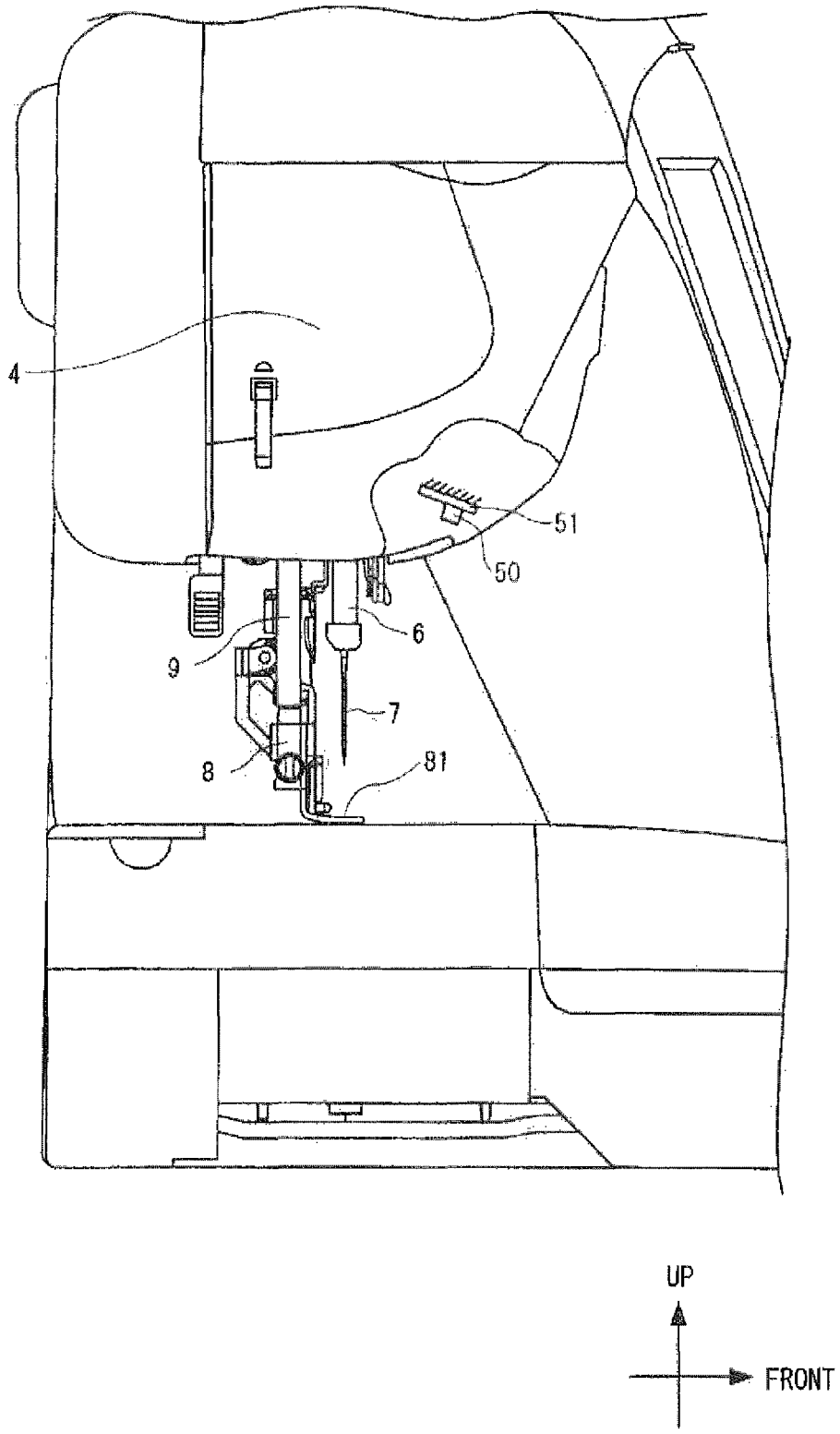
FIG. 3 is a left side view of the sewing machine 10 with a portion of the head 4 cut away.

The configuration of the head 4 will be explained in detail with reference to FIG. 3. A swinging pulse motor 80, the needle bar 6, the needle bar up-and-down moving mechanism, a swinging mechanism, and the presser bar up-and-down moving mechanism are housed inside the head 4. The head 4 supports the needle bar 6 such that the needle bar 6 can move up and down. A sewing needle 7 is mounted on the lower end of the needle bar 6. The needle bar up-and-down moving mechanism moves the needle bar 6 up and down by the rotational force of the drive shaft. When the needle bar 6 is moved downward by the needle bar up-and-down moving mechanism, the sewing needle 7 pierces the work cloth W at a needle drop point P. The swinging mechanism is driven by the swinging pulse motor 80 (FIG. 6) and swings the needle bar 6 to the left and to the right. A presser bar 9 is provided to the rear of the needle bar 6 and can be moved up and down. A presser foot 8 is provided on the lower end of the presser bar 9. The presser foot 8 is provided for pressing down on the work cloth W. The presser foot 8 is provided with a cloth pressing portion 81. The cloth pressing portion 81 presses down on the part of the work cloth W that is underneath the cloth pressing portion 81. The presser bar up-and-down moving mechanism may be the known mechanism that is described in Japanese Laid-Open Patent Publication No. 2011-172801, for example. The presser bar up-and-down moving mechanism operates by being driven by a presser bar up-and-down pulse motor 82, and it moves the presser bar 9 and the presser foot 8 between a raised position and a lowered position. The raised position is a position in which the presser foot 8 is above and not in contact with the work cloth W. The lowered position is a position in which the presser foot 8 presses on the work cloth W. The sewing devices include the presser bar 9, the presser foot 8, and the presser bar up-and-down moving mechanism, which moves the presser bar 9 up and down.

Figure 2:
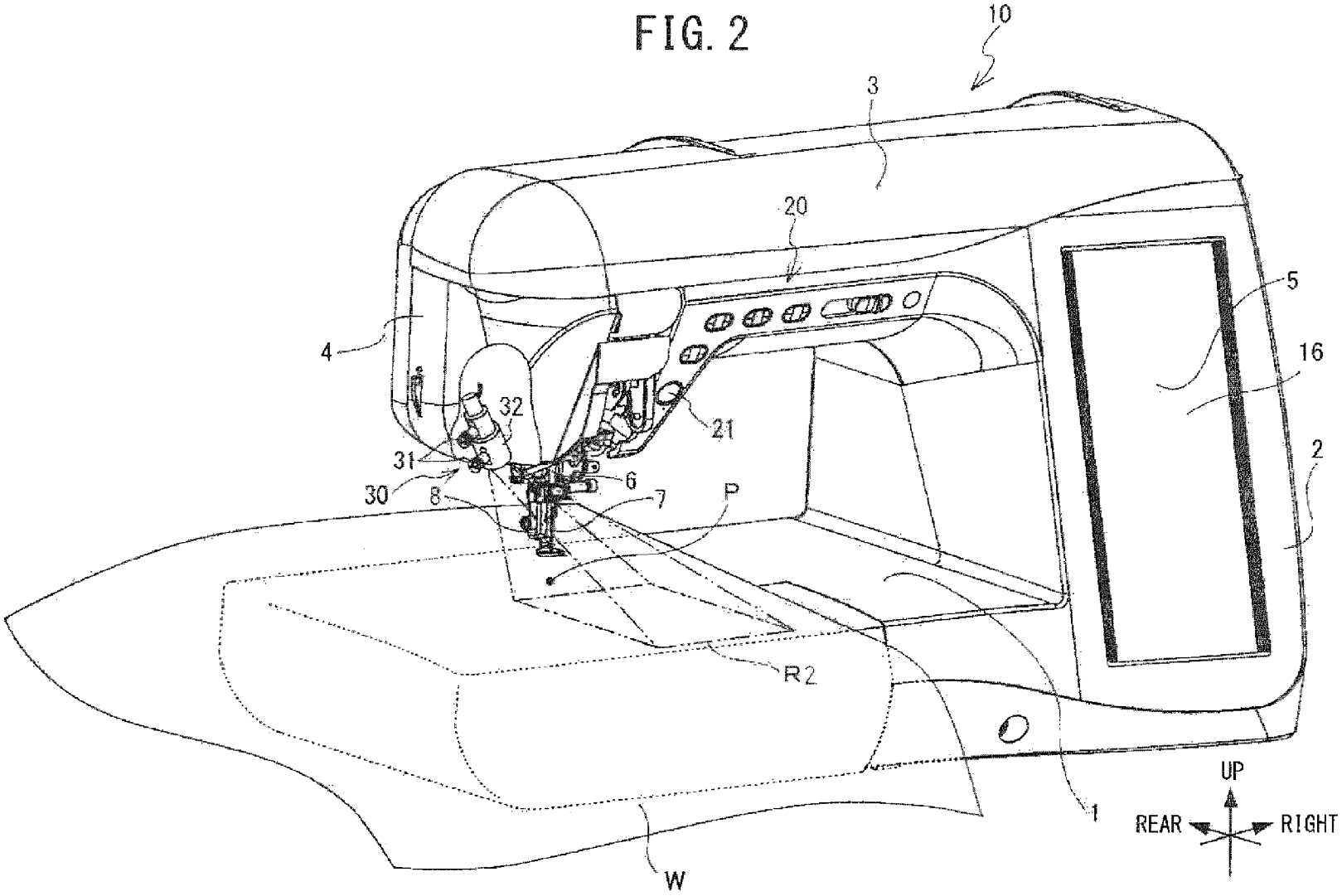
FIG. 2 is an oblique view of the sewing machine 10 in a state in which a work cloth W has been set and with a portion of a head 4 cut away.

An image sensor 50 is provided inside the head 4. Specifically, the image sensor 50 is affixed to a support frame 51 inside the head 4. The support frame 51 is attached to a casing of the sewing machine 10. The image sensor 50 may be, for example, a known CMOS image sensor that is provided with a CMOS sensor and a control circuit. Note that a known CCD sensor may also be used for the image sensor 50, instead of a CMOS sensor. As shown in FIG. 2, the image sensor 50 captures an image of a specified image capture region R1 on the bed 1. The image capture region R1 is a region on the bed 1 that is toward the front from the needle drop point P for the sewing needle 7 that is mounted on the needle bar 6. The image sensor 50 converts incident light into electrical signals and outputs the electrical signals.

Figure 4:
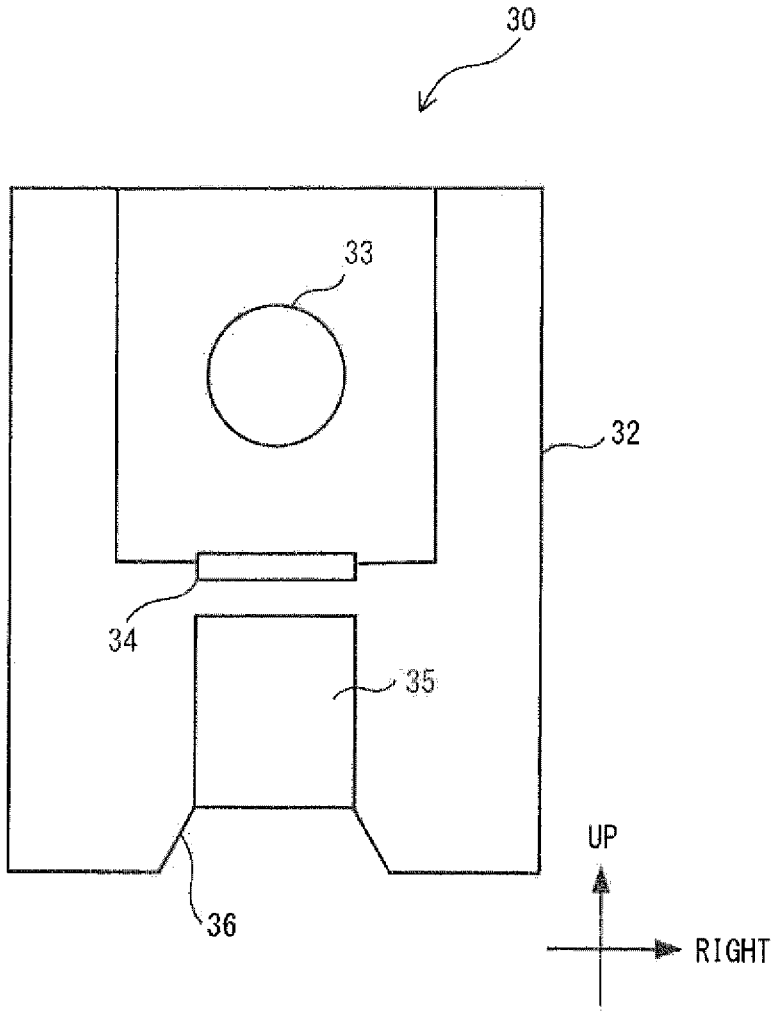
FIG. 4 is a schematic figure of a projector 30.

The configuration of the projector 30 will be explained in detail with reference to FIG. 4. The projector 30 is provided with a housing 32, a light source 33, a liquid crystal panel 34, and an image-forming lens 35. The housing 32 is tube-shaped. A projected light opening 36 is formed in the housing 32. The housing 32 is affixed to a casing of the head 4 in an orientation in which the projected light opening 36 faces downward and toward the right front. The light source 33 may be a metal halide type of discharge lamp, for example. The liquid crystal panel 34 modulates the light from the light source 33. Based on projected image data that are data for the projected image 39, the liquid crystal panel 34 forms a projected image beam that is projected. Through the projected light opening 36, the image-forming lens 35 forms the projected image beam into an image in a projection region R2 that is in the focus position on the one of the bed 1 and the work cloth W. Note that in the present embodiment, the projection region R2 of the projector 30 and the image capture region R1 of the image sensor 50 are congruent.

Projected Image 39

The projected image 39 that is projected into the projection region R2 will be explained with reference to FIG. 5. The projected image 39 is projected by the projector 30 onto the bed 1 toward the front from the needle drop point P for the sewing needle 7 that is mounted on the needle bar 6. The projected image 39 includes operation items 40. The operation items 40 include a sewing start-and-stop item 41, a reverse stitch item 42, a cut thread item 43, a presser foot up-and-down item 44, and a needle bar up-and-down item 45. As will be explained in detail later, when the user designates one of the operation items 41 to 45, an operation that corresponds to the designated item is performed. The sewing start-and-stop item 41 corresponds to the starting and the stopping of the operation of the sewing devices. In other words, the sewing start-and-stop item 41 corresponds to the rotating and the stopping of the sewing machine motor 78. The reverse stitch item 42 corresponds to reverse stitching, for which the direction in which the work cloth W is fed is reversed. During the sewing operation, the work cloth W is fed from the front toward the rear. In a case where reverse stitching is performed, the work cloth W is fed from the rear toward the front. The cut thread item 43 corresponds to thread cutting that cuts the upper thread and the lower thread, which are used for the sewing. The presser foot up-and-down item 44 corresponds to the moving of the up-down position of the presser foot 8 that presses on the work cloth W. The needle bar up-and-down item 45 corresponds to the moving up and down of the stopped position of the needle bar 6. By performing operations through the touch panel 16, the user may also change projection conditions such as the types of the operation items 40, the sizes of the operation items 40, the range in which the operation items 40 are projected, and the like, without being limited to the operation items 40 that are described above.

Electrical Configuration of the Sewing Machine 10

The electrical configuration of the sewing machine 10 will be explained with reference to FIG. 6. The sewing machine 10 is provided with a control portion 60, a card slot 17, and an image processing circuit 50*a*. The control portion 60 is provided with a CPU 61, a ROM 62, a RAM 63, an EEPROM 64, an input interface 65, an output interface 66, a bus 67, and an external access RAM 68. The bus 67 electrically connects the electrical configuration elements of the sewing machine 10 to one another. The input interface 65 is electrically connected to the sewing start-and-stop switch 21, the touch panel 16, a needle bar up-down position sensor 89, and the image processing circuit 50*a*. The output interface 66 is electrically connected to drive circuits 71 to 77 and to the light source 33. The image processing circuit 50*a* is electrically connected to the image sensor 50.

The CPU 61 performs main control of the sewing machine 10 in accordance with a control program that is stored in a control program storage area of the ROM 62. The ROM 62 is a read-only storage element. The RAM 63 is a freely readable and writable storage element, and it is provided with various types of storage areas that store computation results that the CPU 61 computes.

The sewing start-and-stop switch 21 is a button-type switch. The needle bar up-down position sensor 89 is a sensor that detects the position of the needle bar in the up-down direction. Specifically, when the sewing needle 7 is in one of a needle up position and a needle down position, the needle bar up-down position sensor 89 outputs a detection signal to the control portion 60. The needle up position is a position where the sewing needle 7 has been raised to its highest point and the tip of the sewing needle 7 is at the top face of the needle plate 11. The needle down position is a position where the sewing needle 7 has been lowered to its lowest point and the tip of the sewing needle 7 is at the bottom face of the needle plate 11. The image processing circuit 50*a* performs image processing of the image data for the captured image that has been captured by the image sensor 50.

The drive circuit 71 drives the sewing machine motor 78. The sewing machine motor 78 rotationally drives the drive shaft. The drive circuit 72 drives the feed adjustment pulse motor 79. The drive circuit 73 drives the swinging pulse motor 80 that swings the needle bar 6. The drive circuit 76 drives the presser bar up-and-down pulse motor 82. The drive circuit 77 drives the thread-cutting pulse motor 83. The sewing devices include the sewing machine motor 78, the feed adjustment pulse motor 79, the swinging pulse motor 80, the presser bar up-and-down pulse motor 82, the thread-cutting pulse motor 83, and the drive circuits 71 to 73, 76, and 77. The drive circuit 74 drives the LCD 5. The drive circuit 75 drives the liquid crystal panel 34 of the projector 30.

Item Designation Processing

Item designation processing will be explained with reference to FIG. 7. The CPU 61 performs the item designation processing in accordance with an item command program that is stored in the ROM 62. When the user touches an image capture key that is an operation item on an operation screen on the touch panel 16, the CPU 61 performs the processing that is shown in the flowchart in FIG. 7. Each of the steps that are shown in the flowchart indicates processing by the CPU 61. First, the user places a finger on a mark (for example, a x shape) that is provided in a specified position within the image capture region R1 on the bed 1. In the present embodiment, the finger that is placed on the mark is defined as the thumb of the left hand, but the present disclosure is not limited to this example.

At Step S11, the CPU 61 determines whether or not the image capture key that is displayed on the LCD 5 has been pressed by the user. In a case where the CPU 61 determines that the image capture key has been pressed (YES at Step S11), an image of the image capture region R1 is captured by the image sensor 50, and the CPU 61 advances the processing to Step S13. In a case where the CPU 61 determines that the image capture key has not been pressed (NO at Step S11), the CPU 61 repeats the processing at Step S11.

At Step S13, the CPU 61 recognizes the shape and the size of the finger that the user has placed on the mark in the captured image that was captured by the image sensor 50. Based on the image data for the captured image that was captured by the image sensor 50, the image processing circuit 50*a* uses a known image processing method to create finger image data that indicate the shape and the size of the user's finger. The image processing circuit 50*a* outputs the finger image data to the RAM 63. The RAM 63 stores the finger image data. Now an example of the known image processing method will be explained. In order to identify the outline of the finger, the image processing circuit 50*a* converts the image data for the captured image into a gray-scale image, which it then binarizes. Then the image processing circuit 50*a* uses a template matching method to create the finger image data that indicate the shape and the size of the finger. Next, the user places the work cloth W on the bed 1.

At Step S15, the CPU 61 determines whether or not the image capture key that is displayed on the LCD 5 has been pressed by the user. In a case where the CPU 61 determines that the image capture key has been pressed (YES at Step S15), an image of the image capture region R1 is captured by the image sensor 50, and the CPU 61 advances the processing to Step S17. In a case where the CPU 61 determines that the image capture key has not been pressed (NO at Step S15), the CPU 61 repeats the processing at Step S15.

At Step S17, the CPU 61 detects the color of the work cloth W that is shown in the captured image that was captured by the image sensor 50. Specifically, the image processing circuit 50*a* acquires the RGB values for the coordinates that correspond to the position of the work cloth W in the image data for the captured image that was captured by the image sensor 50. The image processing circuit 50*a* uses a known conversion formula to convert the acquired RGB values into HSV values. The image processing circuit 50*a* outputs a computed hue value H to the RAM 63. The RAM 63 stores the hue value H as work cloth color information.

The HSV values will be explained. The HSV values are defined by hue, saturation, and value in the HSV space. Hue is the type of the color, such as red, blue, yellow, or the like. The hue value H may be in the range of zero to 360, for example. The saturation is the vividness of the color. A saturation value S may be in the range of 0.0 to 1.0, for example. The value is the brightness of the color. A value value V may be in the range of 0.0 to 1.0, for example.

At Step S19, the CPU 61 sets the color of the projected image 39 to a color that is different from the color of the work cloth W that was detected at Step S17. For example, the color that is different from the color of the work cloth W may be a complementary color in relation to the color of the work cloth W. In a hue circle, the complementary color is the color that is in a position that is 180 degrees apart from the object color. The complementary color contrasts strongly with the color of the work cloth W, so it makes it easy for the user to visually recognize the projected image 39 that is projected onto the work cloth W. For example, in a case where the color of the work cloth W is blue, the complementary color is yellow. Specifically, the CPU 61 acquires the hue value H as the color of the work cloth W. The CPU 61 adds 180 to the hue value H and defines the results as a hue value H'. The CPU 61 sets the hue value H' as projected image color information and stores it in the RAM 63. Note that in a case where the color of the work cloth W is one of the neutral colors white and black, a color that is stored in advance in one of the ROM 62 and the EEPROM 64 is set as the projected image color information for the color of the projected image 39. The color that is stored in advance may be, for example, a color whose brightness contrasts strongly with the color of the work cloth W.

At Step S21, the CPU 61 controls the drive circuit 75 in order to project the projected image 39 from the projector 30. The projector 30 projects the projected image 39 in the color that was set at Step S19. Specifically, for the projecting of the projected image 39, the CPU 61 reads the projected image color information from the RAM 63. The CPU 61 reads from the RAM 63 the projected image data that correspond to the projection conditions that have been set by the user in advance. The projector 30 projects the projected image 39 based on the projected image color information and the projected image data that have been read. The projected image 39 is projected onto the work cloth W, as shown in FIG. 8. The projected image 39 includes the plurality of the operation items 40.

At Step S23, the CPU 61 determines whether or not the user's finger has touched one of the plurality of the operation items 40. In a case where the CPU 61 determines that the user's finger has touched one of the plurality of the operation items 40 (YES at Step S23), the CPU 61 advances the processing to Step S25. In a ease where the CPU 61 determines that the user's finger has not touched one of the plurality of the operation items 40 (NO at Step S23), the CPU 61 repeats the processing at Step S23.

At Step S25, the CPU 61 detects the operation item 40 that the user's finger has touched, among the plurality of the operation items 40 that are projected onto the work cloth W by the projector 30. In the first embodiment, the CPU 61 detects the operation item 40 that the user's finger has touched based on the position of the user's finger in relation to the positions of the operation items 40 in the projected image 39 that is shown in the captured image that has been captured by the image sensor 50. Assume, for example, that the user's finger has touched the position where the cut thread item 43 is projected onto the work cloth W, as shown in FIG. 8. The CPU 61 detects the cut thread item 43 that is projected at the position that the user's finger has touched on the work cloth W. Specifically, the CPU 61 reads the finger image data from the RAM 63. The CPU 61 compares the finger that is shown in the captured image that has been captured by the image sensor 50 to the finger that is shown in the finger image data. In a case where, as a result of the comparison, the CPU 61 determines that the finger that is shown in the captured image matches the finger that is shown in the finger image data, the CPU 61 detects that the user's finger has touched the work cloth W. Then, by a known image processing method, the CPU 61 specifies the position of a center position C of the thumbnail of the user's thumb. The CPU 61 computes the coordinates of the center position C of the thumbnail in the captured image and compares the coordinates of the center position C to the coordinates of the regions where the individual operation items 40 are projected. The coordinates of the regions where the individual operation items 40 are projected are stored in the RAM 63 in accordance with the projection conditions that the user has set in advance. Based on the result of the comparison of the coordinates of the center position C and the coordinates of the regions where the individual operation items 40 are projected, the CPU 61 specifies the region of the operation item 40 in which the coordinates of the center position C are located. In this manner, the CPU 61 detects that, among the plurality of the operation items 40, the user's finger is positioned on the cut thread item 43. Note that the coordinates of the regions where the individual operation items 40 are projected may also be set to default values.

At Step S27, the CPU 61 controls the sewing devices such that an operation is performed that is in accordance with the type of the operation item 40 that was detected at Step S25. After completing Step S27, the CPU 61 returns the process to Step S23. Next, specific operations will be explained.

In a case where the sewing start-and-stop item 41 is detected at Step S25 while the rotation of the sewing machine motor 78 is stopped, that is, while the sewing is stopped, the CPU 61 starts the sewing operation by starting the rotation of the sewing machine motor 78. That starts the rotation of the drive shaft. In contrast, in a case where the sewing start-and-stop item 41 is detected at Step S25 while the sewing machine motor 78 is rotating, that is, while the sewing operation is in progress, the CPU 61 stops the sewing operation by stopping the rotation of the sewing machine motor 78.

In a case where the reverse stitch item 42 is detected at Step S25 while the sewing machine motor 78 is rotating, that is, while the sewing operation is in progress, the CPU 61 feeds the work cloth W from the rear toward the front by operating the feed adjustment pulse motor 79 such that the direction of movement of the feed dog is reversed. In contrast, in a case where the reverse stitch item 42 is detected at Step S25 while the rotation of the sewing machine motor 78 is stopped, that is, while the sewing is stopped, the CPU 61 feeds the work cloth W from the rear toward the front by operating the feed adjustment pulse motor 79 to reverse the direction of movement of the feed dog and operating the sewing machine motor 78.

In a case where the cut thread item 43 is detected at Step S25, the CPU 61 cuts the upper thread and the lower thread by operating the thread-cutting pulse motor 83.

In a case where the presser foot up-and-down item 44 is detected at Step S25 while the presser foot 8 is in the lowered position and pressing on the work cloth W, the CPU 61 operates the presser bar up-and-down pulse motor 82 to move the presser foot 8 to the raised position, where it is not in contact with the work cloth W. In contrast, in a case where the presser foot up-and-down item 44 is detected at Step S25 while the presser foot 8 is in the raised position, the CPU 61 operates the presser bar up-and-down pulse motor 82 to move the presser foot 8 to the lowered position.

In a case where the needle bar up-and-down item 45 is detected at Step S25 while the stopped position of the sewing needle 7 is the needle up position, the CPU 61 starts the rotation of the sewing machine motor 78 and rotates the drive shaft 180 degrees. The rotating of the drive shaft drives the needle bar up-and-down moving mechanism, which moves the sewing needle 7 from the needle up position to the needle down position and then stops. In contrast, in a case where the needle bar up-and-down item 45 is detected at Step S25 while the stopped position of the sewing needle 7 is the needle down position, the CPU 61 starts the rotation of the sewing machine motor 78 and rotates the drive shaft 180 degrees. The rotating of the drive shaft drives the needle bar up-and-down moving mechanism, which moves the sewing needle 7 from the needle down position to the needle up position and then stops.

Configuration of a Sewing Machine 10B in a Second Embodiment

Figure 9:
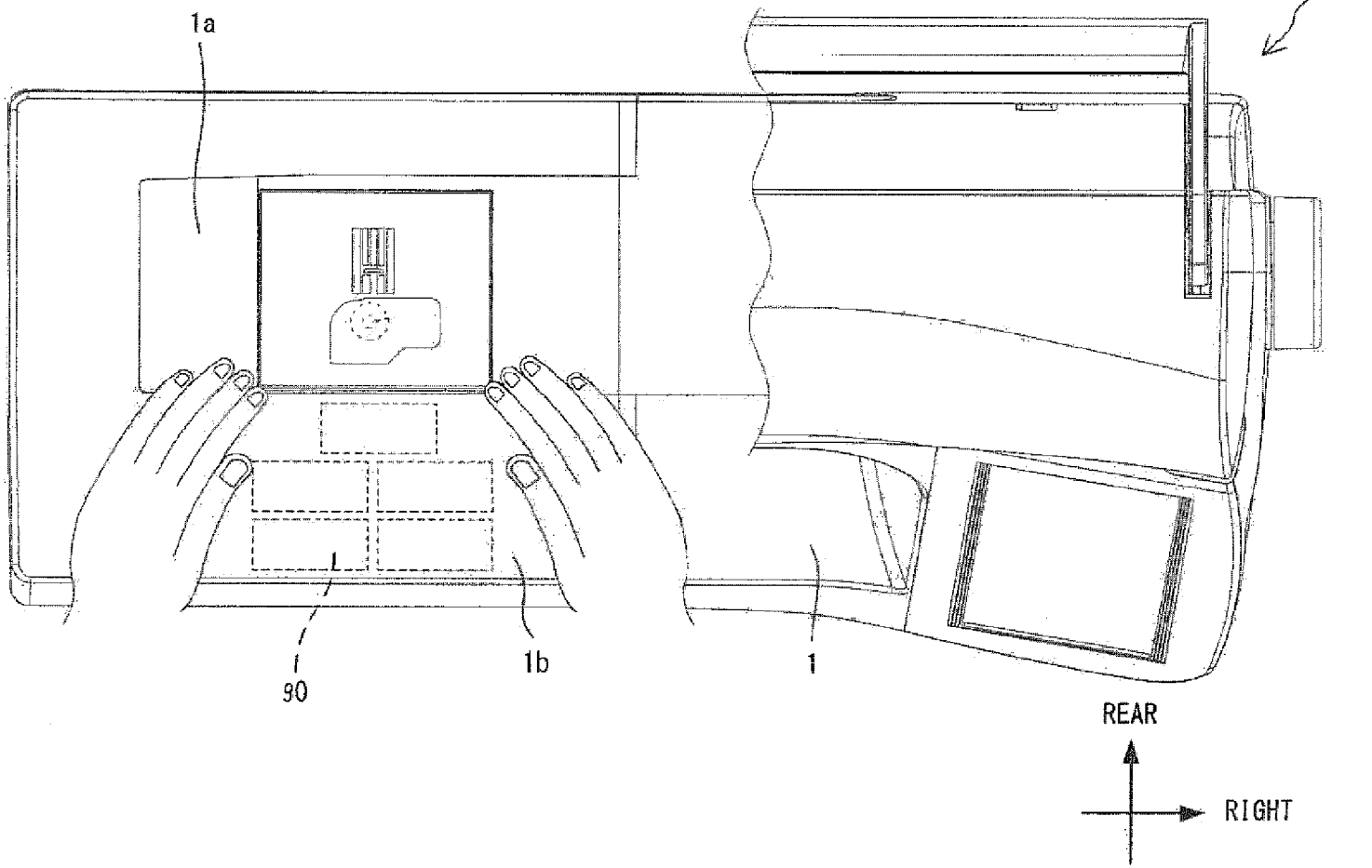
FIG. 9 is a plan view of a sewing machine 10B in a second embodiment of the present disclosure, in which touch sensors 90 are provided.

A sewing machine 10B in a second embodiment will be explained with reference to FIG. 9. The configuration of the sewing machine 10B in the second embodiment differs from the configuration of the sewing machine 10 in the first embodiment in that the sewing machine 10B is provided with a touch sensors 90, as shown schematically in FIG. 9, Note that the same reference numerals are used for the elements that are the same as in the sewing machine 10 in the first embodiment, so explanations of those elements will be omitted.

The touch sensors 90 detect positions that the user's finger presses. The touch sensors 90 are provided on the top face of the auxiliary table 1*b*. Specifically, the touch sensors 90 are provided in the same position as the projection region R2 on the bed 1 in the sewing machine 10 in the first embodiment. The positions where the touch sensors 90 are provided match the positions on the bed 1 of the plurality of the operation items 40 that are projected by the projector 30. The touch sensors 90 that are located in the auxiliary table 1*b* are electrically connected to the control portion 60 that is located in the body 1*a*.

The touch sensors 90 are provided with a plurality of sensor switches that are provided in positions that correspond to each one of the plurality of the operation items 40. The touch sensors 90 may be known membrane switches, for example. The user presses on the touch sensors 90 from the top side of the work cloth W. The touch sensors 90 detect pressing positions that the user's finger has pressed. The pressing positions are stored in the ROM 62 in advance, in association with the operation items 40.

Figure 7:
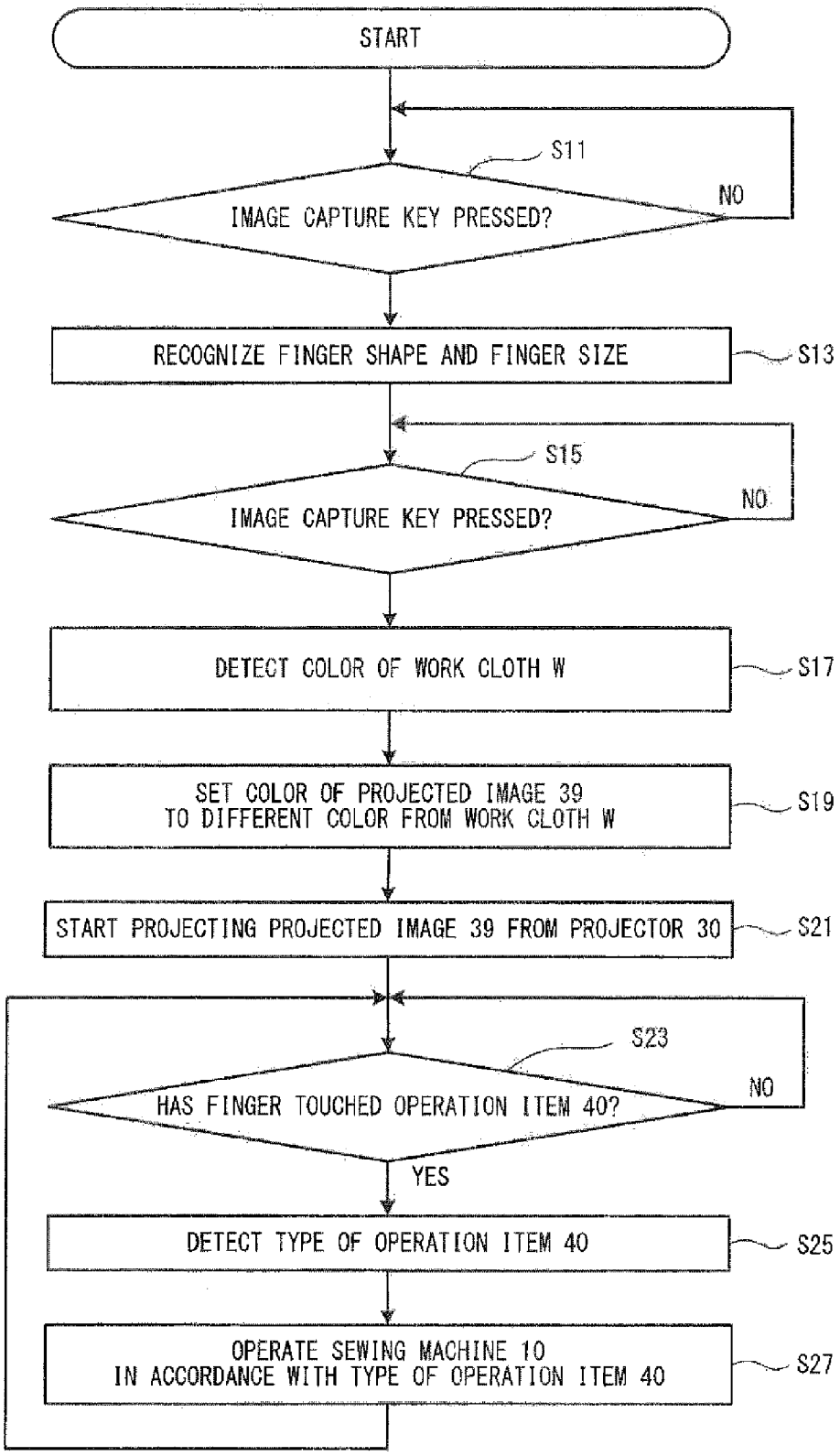
FIG. 7 is a flowchart of item designation processing in the sewing machine 10.

In the second embodiment, the CPU 61 does not perform the processing at Steps S11 and S13 that are shown in FIG. 7. In processing that is equivalent to the processing at Step S21, the CPU 61 starts causing the projector 30 to project the projected image 39 and puts the touch sensors 90 into a state in which they can detect the pressing position of the user's fingers. Thus the sewing machine 10B detects one of the operation items 40 only in a case where the user is able to designate one of the operation items 40. In other words, when the projected image 39 is not being projected, even if the user presses one of the touch sensors 90, the sewing machine 10B will not operate in response to the pressing of the corresponding item. The user is therefore able to perform sewing work safely.

In the second embodiment, in the processing that is equivalent to the processing at Step S25, the CPU 61 detects the operation item 40 that the user has touched within the projection region R2 on the work cloth W where the operation items 40 are projected by the projector 30. In the second embodiment, the CPU 61 detects the operation item 40 that the user has touched based on the pressing position that was detected by one of the touch sensors 90. The same sort of effects as those demonstrated by the sewing machine 10 in the first embodiment are also demonstrated in the sewing machine 10B in the second embodiment that is configured as described above.

Effects of the Embodiments

In the first embodiment, the sewing machine 10 detects whether the user's finger has touched one of the operation items 40 that are projected onto the work cloth W by the projector 30. The sewing machine 10 operates in accordance with the operation item 40 that the user has designated. That makes it possible for the user to designate a sewing-related operation to the sewing machine 10 without removing one hand from the work cloth W.

In the first embodiment, the sewing machine 10 detects the operation item 40 that the user has designated based on the position of the user's finger in relation to a position in the projected image 39 that is shown in the captured image that has been captured by the image sensor 50. Thus it is possible for the operation item 40 that the user has designated to be detected more accurately.

In the first embodiment, the projector 30 projects the projected image 39 onto the work cloth W in a color that is different from the color of the work cloth W. Because the color of the projected image 39 and the color of the work cloth W are different, the user can reliably recognize the projected image 39.

In the second embodiment, the sewing machine 10B is provided with the touch sensors 90, which are provided on the bed 1 and detect the position that the user's finger has touched. The touching of the user's finger on one of the bed 1 and the work cloth W can thus be detected more accurately.

In the first embodiment, the projector 30 projects the projected image 39 of the operation items 40 onto the bed 1 toward the front from the needle bar 6. That makes it possible for the user to designate a sewing-related operation to the sewing machine 10 with the distance that the user's finger moves being as short as possible.

Modified Examples

The present disclosure is not limited to the embodiments that have been described above, and various types of embodiments can be implemented within the scope of the present disclosure.

In the first embodiment, the projection region R2 of the projector 30 matches the image capture region R1 of the image sensor 50, but it is also acceptable for the two regions not to match. The projector 30 need only be able to project onto at least one of the bed 1 and the work cloth W. For example, it is acceptable for the projector 30 to project the projected image 39 only onto the bed 1. To take another example, it is acceptable for the projector 30 to project the projected image 39 in a state in which the work cloth W is positioned only in the left half of the projection region R2, with the bed 1 being exposed in the right half of the projection region R2. In that case, the projected image 39 would be projected such that it overlaps both the bed 1 and the work cloth W, in a color that is different from both the color of the bed 1 and the color of the work cloth W. The image sensor 50 need only be able to capture an image over a specified range that includes the projection region R2 on the bed 1. The image sensor 50 may also detect the positions of the user's left hand and right hand that are both visible on the work cloth W. The projector 30 may then project the projected image 39 into a projection region that is based on the positions of the user's left hand and right hand that have been detected by the image sensor 50. The projection region that is based on the positions of the user's left hand and right hand may be a region that is between the user's left hand and right hand, for example.

In the embodiments, the operation items 40 include the sewing start-and-stop item 41, the reverse stitch item 42, the cut thread item 43, the presser foot up-and-down item 44, and the needle bar up-and-down item 45. However, the operation items 40 are not limited to those items and may also include a sewing speed adjustment item that designates a speed at which the sewing will be performed by the sewing devices. By touching the work cloth W onto which the sewing speed adjustment item is projected, the user is able to adjust the sewing speed, or more specifically, the revolution speed of the sewing machine motor 78, without taking one hand off of the work cloth W. The projector 30 is also not restricted to projecting the items that are listed above and may also project only the items that are operable, depending on the state of the sewing machine 10. For example, the sewing machine 10 is set such that it can perform the operations to change the up-down position of the sewing needle 7 and the up-down position of the presser foot 8 only in a case where the sewing machine 10 is not performing the sewing. Therefore, in a case where the sewing machine 10 is performing the sewing, it is acceptable for the projector 30 to project the projected image 39 without the presser foot up-and-down item 44 and the needle bar up-and-down item 45. The user is thus able to select only the operable items. Furthermore, in a case where the sewing machine 10 is performing the sewing, it is acceptable for the projector 30 to project the word "Stop" in the region where the sewing start-and-stop item 41 is projected. In a case where the sewing machine 10 has stopped the sewing, it is acceptable for the projector 30 to project the word "Start" in the region where the sewing start-and-stop item 41 is projected. The user is thus able to recognize the operation items 40 without making any mistakes.

In the first embodiment, at Step S19, the CPU 61 sets the complementary color of the color of the work cloth W as the color that is different from the color of the work cloth W. However, the choice is not limited to the complementary color and may be a color of any hue that is different from the color of the work cloth W.

In the second embodiment, the touch sensors 90 are provided in the auxiliary table 1*b*. However, the touch sensors 90 are not limited to being provided in the auxiliary table 1*b*, and they may also be provided in a wide table on which the work cloth W is placed when it is large.

Note that the programs that have been described above may also be stored in a computer-readable storage medium such as a hard disk, a flexible disk, a CD-ROM, a DVD, or the like, and they may be executed by being read from the storage medium by a computer. The programs may also be in the form of a transmission medium that can be distributed through a network such as the Internet or the like.

In the first embodiment and the second embodiment, an item detection portion that detects that the user's finger has touched the work cloth W on which the operation items 40 are projected, a control portion that operates the sewing devices in accordance with the operation item 40 that has been detected, a color detection portion that detects the color of at least one of the bed 1 and the work cloth W that are visible in the captured image, and a setting portion that sets, as the color of the projected image 39, a color that is different from the color of the at least one of the bed 1 and the work cloth W may be implemented in the form of software that the CPU 61 executes and may also be implemented in the form of hardware that performs the functions of the individual portions.

What is claimed is:

1. A sewing machine, comprising:

a bed on which a work cloth is placed;

a sewing device that includes a needle bar, on a lower end of which a sewing needle is mounted, and a feed portion that moves the work cloth;

a projection portion that projects, onto at least one of the bed and the work cloth, a projected image that includes at least one operation item that indicates an operation of the sewing device;

an item detection portion that detects whether a user's finger has touched a location, on the at least one of the bed and the work cloth onto which the at least one operation item is being projected by the projection portion, where one of the at least one operation item is being projected; and a control portion that operates the sewing device in accordance with the operation item that has been detected by the item detection portion.

2. The sewing machine according to claim 1, further comprising:

an image capture portion that is configured to capture an image of the bed, wherein the item detection portion detects the operation item that is being projected at the location that the user's finger has touched, based on the position of the user's finger in relation to the projected image, as shown in a captured image that has been captured by the image capture portion.

3. The sewing machine according to claim 2, further comprising:

a color detection portion that detects the color of at least one of the bed and the work cloth, which are shown in the captured image that has been captured by the image capture portion; and a setting portion that sets, as the color of the projected image, a color that is different from the color of the at least one of the bed and the work cloth that has been detected by the color detection portion, wherein the projection portion projects the projected image in the color that has been set by the setting portion.

4. The sewing machine according to claim 1, further comprising:

a pressing detection portion that is provided in a region of the bed where the at least one operation item is projected by the projection portion and that detects a pressing position, wherein the item detection portion detects the operation item that is being projected at the location that the user's finger has touched, based on the pressing position that has been detected by the pressing detection portion.

5. The sewing machine according to claim 1, wherein the projection portion projects the projected image onto the bed on the upstream side of the needle bar in relation to the direction in which the work cloth is moved by the feed portion.

6. The sewing machine according to claim 1, wherein the at least one operation item includes at least one of an item that indicates one of start and stop operation of the sewing device, an item that indicates reverse stitching that reverses the direction in which the work cloth is moved, an item that indicates thread cutting that cuts an upper thread and a lower thread that are used for sewing, an item that indicates an up-down position of a presser foot that presses on the work cloth, an item that indicates a stopped position of the needle bar, and an item that indicates a speed of sewing by the sewing device.

7. A non-transitory computer-readable medium storing computer-readable instructions that cause a sewing machine to perform the following steps:

projecting, onto at least one of a work cloth and a bed on which the work cloth is placed, a projected image that includes at least one operation item that indicates an operation of sewing device that performs sewing on the work cloth;

detecting whether a user's finger has touched a location, on the at least one of the bed and the work cloth onto which the at least one operation item is being projected, where one of the at least one operation item is being projected; and causing the sewing device to perform an operation that corresponds to the operation item that has been detected.

8. A sewing machine comprising:

a processor; and a memory configured to store computer-readable instructions cause the processor to perform processes comprising:

projecting, onto at least one of a bed on which a work cloth is placed and the work cloth by a projection portion, a projected image that includes at least one operation item that indicates an operation of a sewing device including a needle bar, on a lower end of which a sewing needle is mounted, and a feed portion that moves the work cloth;

detecting whether a user's finger has touched a location, on the at least one of the bed and the work cloth onto which the at least one operation item is being projected by the projection portion, where one of the at least one operation item is being projected; and operating the sewing device in accordance with the operation item that has been detected.

9. The sewing machine according to claim 8, wherein the detecting whether a user's finger has touched the location includes detecting the operation item that is being projected at the location that the user's finger has touched, based on the position of the user's finger in relation to the projected image, as shown in a captured image that has been captured by an image capture portion that is configured to capture an image of the bed.

10. The sewing machine according to claim 9, wherein the computer-readable instructions further cause the processor to perform a process comprising:

detecting the color of at least one of the bed and the work cloth, which are shown in the captured image that has been captured by the image capture portion; and setting, as the color of the projected image, a color that is different from the color of the at least one of the bed and the work cloth that has been detected, wherein the projecting the projected image includes projecting the projected image in the color that has been set.

11. The sewing machine according to claim 8, wherein the detecting the operation item includes detecting the operation item that is being projected at the location that the user's finger has touched, based on a pressing position that has been detected by a pressing detection portion, the pressing detection portion that is provided in a region of the bed where the at least one operation item is projected by the projection portion and that detects the pressing position.

12. The sewing machine according to claim 8, wherein the projecting the projected image includes projecting image onto the bed on the upstream side of the needle bar in relation to the direction in which the work cloth is moved by the feed portion.

13. The sewing machine according to claim 8, wherein the at least one operation item includes at least one of an item that indicates one of start and stop operation of the sewing device, an item that indicates reverse stitching that reverses the direction in which the work cloth is moved, an item that indicates thread cutting that cuts an upper thread and a lower thread that are used for sewing, an item that indicates an up-down position of a presser foot that presses on the work cloth, an item that indicates a stopped position of the needle bar, and an item that indicates a speed of sewing by the sewing device.

* * * * *